US009536661B2

(12) United States Patent
Itoh et al.

(10) Patent No.: US 9,536,661 B2
(45) Date of Patent: Jan. 3, 2017

(54) METHOD OF PRODUCTION OF TRANSFORMER MODULE

(71) Applicant: FUJITSU LIMITED, Kawasaki-shi, Kanagawa (JP)

(72) Inventors: Masayuki Itoh, Kawasaki (JP); Hiroshi Kurosawa, Kawasaki (JP)

(73) Assignee: FUJITSU LIMITED, Kawasaki (JP)

( * ) Notice: Subject to any disclaimer, the term of this patent is extended or adjusted under 35 U.S.C. 154(b) by 201 days.

(21) Appl. No.: 14/485,915

(22) Filed: Sep. 15, 2014

(65) Prior Publication Data

US 2015/0096168 A1 Apr. 9, 2015

(30) Foreign Application Priority Data

Oct. 9, 2013 (JP) ..... 2013-211897

(51) Int. Cl.

| | |
|---|---|
| ***H01F 7/06*** | (2006.01) |
| ***H01F 41/10*** | (2006.01) |
| ***H01F 27/02*** | (2006.01) |
| *H01F 19/08* | (2006.01) |

(52) U.S. Cl.

CPC ..... *H01F 41/10* (2013.01); *H01F 27/027* (2013.01); *H01F 2019/085* (2013.01); *Y10T 29/49071* (2015.01); *Y10T 29/49073* (2015.01)

(58) Field of Classification Search

CPC ..... H01F 17/062; H01F 27/24; H01F 41/02; H01F 27/306; Y10T 29/49071; Y10T 29/49073; G01R 15/183

USPC ..... 29/605, 601, 602.1, 606, 607, 877; 336/92, 107, 196, 206; 439/602.17, 439/620.01, 620.06, 620.15, 676

See application file for complete search history.

(56) References Cited

U.S. PATENT DOCUMENTS 8,147,278 B2 * 4/2012 Renteria ..... H01R 13/6658 439/676
8,496,499 B2 * 7/2013 Gutierrez ..... H01F 27/027 439/620.01

FOREIGN PATENT DOCUMENTS

| | | |
|---|---|---|
| JP | 06-290981 A | 10/1994 |
| JP | 08-064430 A | 3/1996 |
| JP | 11-243021 A | 9/1999 |

* cited by examiner

*Primary Examiner* — Thiem Phan
(74) *Attorney, Agent, or Firm* — Squire Patton Boggs (US) LLP

(57) ABSTRACT

A method of producing a transformer module by placing at least one transformer which includes a core, a primary winding, and a secondary winding at a bottom surface of a case at which a plurality of external terminals are provided. The method comprising placing two support columns on the bottom surface, placing the bottom surfaces of cores near the lead-out points of the leads of the windings at the two sides of the cores on core support parts of the two support columns to support them, stringing leads at the two sides of the cores to the external terminals and electrically joining them, removing the two support columns so that the bottom surfaces of the cores are placed on the bottom surface of the case, then fastening the cores to the bottom surface of the case to produce a transformer module where the leads from the cores are given excess length.

19 Claims, 10 Drawing Sheets

METHOD OF PRODUCTION OF TRANSFORMER MODULE

CROSS-REFERENCE TO RELATED APPLICATION

This application claims priority from, and incorporates by reference the entire disclosure of, Japanese Patent Application No. 2013-211897 filed on Oct. 9, 2013.

FIELD

The present application relates to a method of production of a transformer module.

BACKGROUND

Known in the past has been a choke transformer for a power circuit which is comprised of a plate-shaped magnetic core (hereinafter referred to simply as a "core"), a coil which is wound around the core, and two terminals which are formed at the two end parts of the surface of the core and which are electrically joined to the two ends of the coil (for example, see Japanese Laid-Open Patent Publication No. 11-243021). In this choke coil, the lead wires are connected to the terminals by high temperature solder. The terminals are bonded to the surface of the core by a conductive binder so that the lead wires are interposed between the terminals and the core.

In recent years, the spread of the Internet, digital TV, etc. has led to the use of pulse transformers as transformer modules for efficiently transmitting pulse signals which are handled by the digital circuits. In particular, LAN interface devices which are mounted in PCs and other information devices and in AV equipment combining video and audio use pulse transformers for the purpose of insulation and noise elimination. A pulse transformer is configured the same as a power transformer which is designed for voltage conversion and comprises a core around which a primary side and secondary side windings are wound. These are insulated and not electrically joined. In a pulse transformer, a signal is transmitted by magnetic coupling. Voltage is induced proportional to the number of windings in the same way as a power transformer.

As illustrated in FIGS. 1A and 1B, a transformer module 2 has transformers 10 which are mounted in a case 20 of a type with external terminals 30 which are formed in gull wing shapes (L-shapes) taken out from the two side surfaces. The case 20 in which the transformers 10 are mounted has a size of a vertical 10 mm, horizontal 18 mm, and height 2 mm or so. The transformers 10 which are mounted inside it have cores 12 of sizes of diameters of 2 to 4 mm or so.

When connecting the windings 14 which are wound around the cores 12 of the transformers 10 which are carried in the case 20 to the external terminals 30, as illustrated in FIG. 1B, the end parts (hereinafter called "leads") 60 of the windings 14 are generally wound around the winding parts 32 of the external terminals 30 and then joined there by solder etc. Note that, FIG. 1B omits the illustration of the solder for joining the leads 60 of the windings 14 which are wound around the winding parts 32 of the external terminals 30 to the winding parts 32. When winding the leads 60 of the windings 14 around the winding parts 32 of the external terminals 30, the leads 60 of the windings 14 are wound around the winding parts 32 in a tensed state, so there is no longer any slack in the leads 60 of the windings 14 and tensile force is generated.

In the transformer module 2 which is illustrated in FIG. 1B, if the transformer module 2 is mounted on a circuit board with the tensile force which is generated at the leads 60 of the windings 14 which are wound around the cores 12 maintained as it is, for example, in the reflow process of the solder, the leads 60 of the windings 14 will thermally expand and stretch due to the heat of the solder. In this regard, if the heat is cooled off after the transformer module 2 is mounted on the circuit board, the expanded leads 60 of the windings 14 will thermally contract and shrink and may cause the leads 60 to break.

SUMMARY

In one aspect, the present invention has as its object to provide a method of production of a transformer module which maintains a high reliability between the windings and external terminals of the transformers while reducing breakage of the transformer windings.

According to one aspect of the embodiments, there is provided a method of production of a transformer module which comprises a case inside of which transformers which include cores, primary windings, and secondary windings are set at a part placement surface and where leads of the primary windings and secondary windings are connected to external terminals which are provided at the case, which method of production of a transformer module comprising inserting spacers at the bottom surfaces of the cores to separate the bottom surfaces of the cores from the part placement surface and support them, stringing the leads from the cores to the external terminals and electrically joining them, after joining them, removing the spacers to place the bottom surfaces of the cores at the part placement surface, and fastening the cores to the part placement surface.

DESCRIPTION OF EMBODIMENTS

Figure 1A:
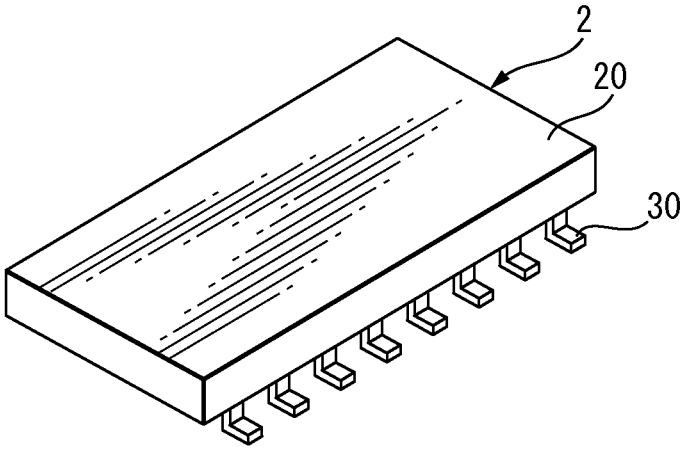
FIG. 1A is a perspective view of a package of a transformer module of the comparative art as seen from the top surface side.
Figure 1B:
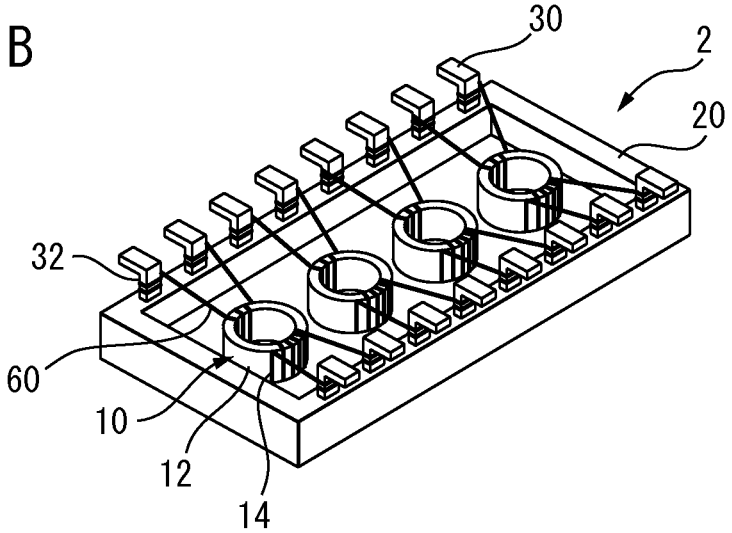
FIG. 1B is a back view of the transformer module which is illustrated in FIG. 1A as seen from the back surface side.

Below, the attached drawings will be used to explain the present application in detail based on specific embodiments. Note that, members the same as those which are inside the transformer module 2 of the comparative art which was explained in FIG. 1A and FIG. 1B and which are used in the embodiments of the present application as well are assigned the same reference notations. That is, the transformers 10, cores 12, windings 14, case 20, external terminals 30, winding parts 32, and leads 60 are described by the same reference notations.

Figure 2A:
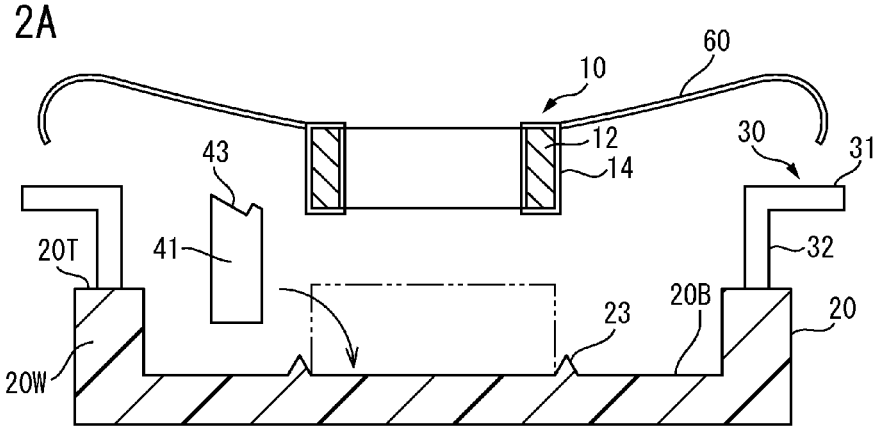
FIG. 2A to FIG. 2C are process diagrams which illustrate steps of a first embodiment of a method of production of a transformer module of the present application.

First, using FIGS. 2A to 2C and FIGS. 3A and 3B, a first embodiment of the method of production of the transformer module 3 of the present application will be explained. In the method of production of the first embodiment, first, as illustrated in FIG. 2A, a case 20 for producing the transformer module 3 is prepared. For the case 20 of the transformer module 3, it is possible to use one of approximately the same shape and the same material as the case 20 which was explained in FIG. 1A and FIG. 1B. Further, a bottom surface 20B of the case 20 forms a part placement surface.

At the top surfaces 20T of wall parts 20W which are provided along the two sides of the case 20 in the longitudinal direction of the bottom surface 20B, a plurality of external terminals 30 are provided. The external terminals 30 are provided with winding parts 32 which are vertical to the top surfaces 20T and mounting parts 31 which extend from the front end parts of the winding parts 32 parallel to the top surfaces 20T. That is, the external terminals 30 are formed in the gull wing shapes (L-shapes) which were explained in the comparative art. The mounting parts 31 are used at the time of mounting the transformer module 3 on a board.

Further, at the bottom surface 20B, ring-shaped ridges 23 are provided for positioning the transformers. The ridges 23 have cross-sections of equilateral triangular shapes. The ridges 23 are provided in exactly the same number as the maximum number of transformers which can be mounted on the bottom surface 20B. The maximum number of transformers which are mounted on the bottom surface 20B is determined by the number of the external terminals 30. For example, when there are 16 external terminals 30, four leads are led out from each transformer, and one lead is connected to each external terminal 30, a maximum of four transformers can be mounted on the bottom surface 20B.

The transformers 10 which are mounted on the bottom surface 20B of the case 20 are toroidal in shape and are provided with ring-shaped cores 12. Windings 14 are wound around the cores 12. The windings 14 of the transformers 10 include primary side windings and secondary side windings. Further, from the start parts and the end parts of the windings 14 of the cores 12, leads 60 for connection with the external terminals 30 are led out. The leads 60, in the same way as the transformer modules 1A and 2 of the comparative art which was explained in FIG. 1, are wound around the winding parts 32 of the external terminals 30.

The transformers 10 are mounted at positions which are illustrated by the two-dot chain lines at the bottom surface 20B of the case 20, but in the present embodiment, before placing the transformers 10 on the bottom surface 20B, detachable first support columns 41 are placed at the insides of the ridges 23 which are provided on the bottom surface 20B. At the top surfaces of the first support columns 41, support parts 43 are formed which support inside parts of the bottom surfaces of the cores 12 of the transformers 10.

Figure 2B:
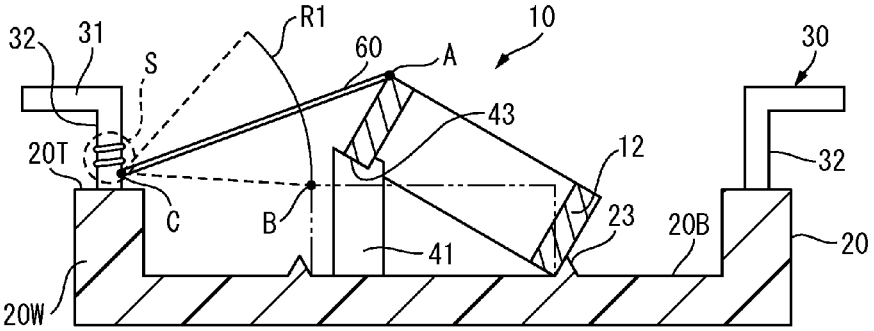

Further, as illustrated in FIG. 2B, the outsides of the bottom surfaces of the cores 12 of the transformers 10 are engaged with the ridges 23. In that state, the insides of the bottom surfaces of cores 12 at the opposite sides are supported by the support parts 43 of the first support columns 41 whereby the cores 12 are made to be inclined on the bottom surface 20B. By making the heights of the first support columns 41 ones by which the cores 12 become inclined from the bottom surface 20B by 30°, the inclination angles of the outer circumferential surfaces of the cores 12 which are engaged with the ridges 23 become 60° with respect to the bottom surface 20B or the same as the inclination angles of the side surfaces of the ridges 23 with respect to the bottom surface 20B. The inclination angles will be explained later. In this state, the leads 60 which are led out from the cores 12 at the sides far from the bottom surface 20B are wound around the winding parts 32 of the external terminals 30 in the tensed state and are electrically joined by solder S. Instead of solder, a conductive binder may also be used. FIG. 2B omits illustration of the leads 60 at the sides not wound around the external terminals 30.

After this, the first support columns 41 are removed and the bottom surfaces of the cores 12 are lowered from the states raised up by the first support columns 41 and are placed on the bottom surface 20B of the case 20 at the insides of the ridges 23. Here, a lead-out point of a lead 60 of a core 12 which is raised by a first support column 41 is designated as "A". To give excess length to the lead 60 between the lead-out point B of the lead 60 of the core 12 when the bottom surface of the core 12 is placed on the bottom surface 20B of the case 20 and the start point C of the lead of the winding part 32 of the external terminal 30, the distance between A-C has to be larger than the distance between B-C by the amount of the excess length. That is, when drawing an arc R1 which is centered about the point C and passes through the point B, if the lead-out point A which is raised by the first support column 41 is separated from this arc R1 by the excess length, when placing the bottom surface of the core 12 on the bottom surface 20B of the case 20, the lead 60 can be given an excess length. The height of the first support column 41 should be set so that this condition is satisfied. The height of the first support column 41 when making the inclination angle of the core 12 with respect to the bottom surface 20B an angle of 30° satisfies this condition.

Figure 2C:
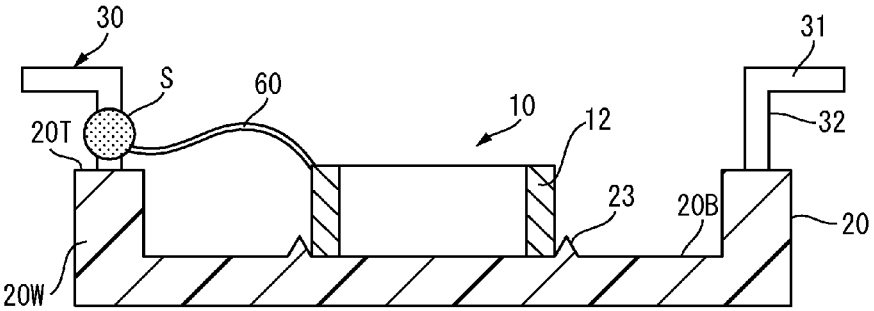

FIG. 2C illustrates the state when removing the first support columns 41 from the state which is illustrated in FIG. 2B and placing the raised bottom surfaces of the cores 12 on the bottom surface 20B in the ridges 23. FIG. 2C omits the illustration of the leads 60 at the sides not wound around the external terminals 30. As explained above, the distance between A-C is larger than the distance between B-C by the amount of the excess length, so if placing the bottom surfaces of the cores 12 on the bottom surface 20B inside the ridges 23, the leads 60 are given excess length and flex.

Figure 3A:
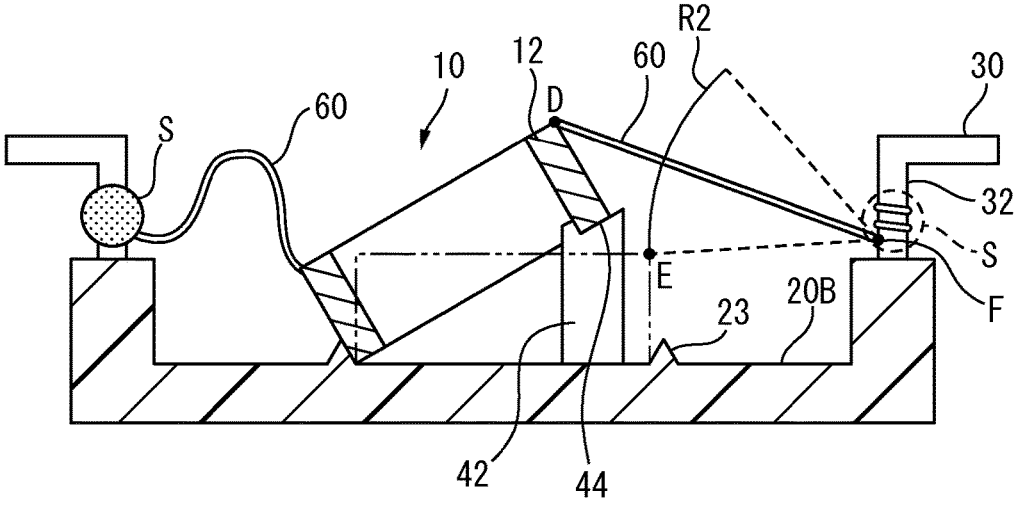
FIG. 3A and FIG. 3B are process diagrams which illustrate steps of a first embodiment of a method of production of a transformer module of the present application.

Next, as illustrated in FIG. 3A, the outsides of the bottom surfaces of the cores 12 at the sides where the leads 60 are connected to the external terminals 30 are engaged with the ridges 23. In that state, the bottom surfaces of the cores 12 at the opposite sides are raised up. Further, second support columns 42 are placed at the bottom surface 20B inside the ridges 23, the cores 12 are lowered to make the insides of the bottom surfaces be supported at the support parts 44 of the second support columns 42, and the cores 12 are made to be inclined on the bottom surface 20B. If making the cores 12 incline with respect to the bottom surface 20B by 30° by adjusting the heights of the second support columns 42, the inclination angles of the outer circumferential surfaces of the cores 12 which are engaged with the ridges 23 become 60° with respect to the bottom surface 20B or the same as the inclination angles of the side surfaces of the ridges 23 with respect to the bottom surface 20B. In this state, the leads 60 which are led out from the cores 12 at the sides far from the bottom surface 20B are wound around the winding parts 32 of the external terminals 30 in the tensed state and are electrically joined by solder S.

Figure 3B:
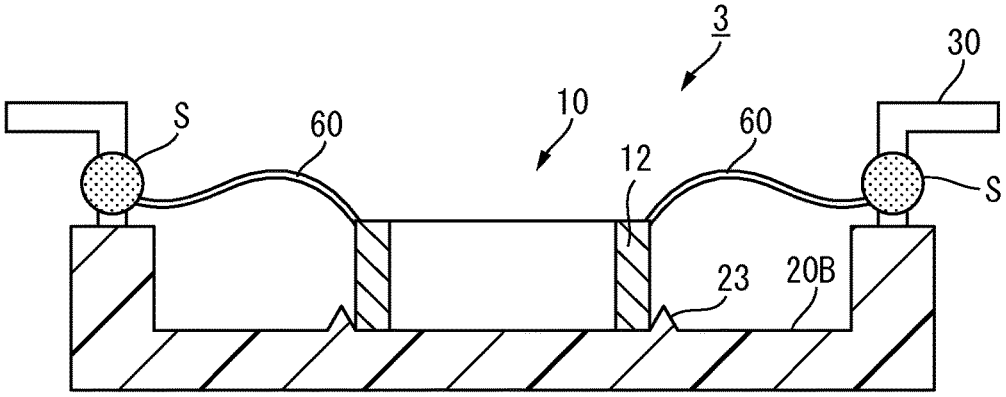

After this, the second support columns 42 are removed and the bottom surfaces of the cores 12 are lowered from the states raised up by the second support columns 42 and are placed on the bottom surface 20B of the case 20 at the insides of the ridges 23. Here, a lead-out point of a lead 60 of a core 12 which is raised by a second support column 42 is designated as "D". To give excess length to the lead 60 between the lead-out point E of the lead 60 of the core 12 when the bottom surface of the core 12 is placed on the bottom surface 20B of the case 20 and the start point F of the lead of the winding part 32 of the external terminal 30, the distance between D-F has to be sufficiently larger than the distance between E-F. That is, when drawing an arc R2 which is centered about the point F and passes through the point E, if the lead-out point D which is raised by the second support column 42 is separated from this arc R2 by the excess length, when placing the bottom surface of the core 12 on the bottom surface 20B of the case 20, the lead 60 can be given an excess length. The height of the second support column 42 should be set so that this condition is satisfied. The height of the second support column 42 when making the inclination angle of the core 12 with respect to the bottom surface 20B an angle of 30° satisfies this condition. If removing the second support column 42 and placing the bottom surface of the core 12 on the bottom surface 20B inside the ridge 23, as illustrated in FIG. 3B, all of the leads 60 are given excess length and flex.

Figure 10:
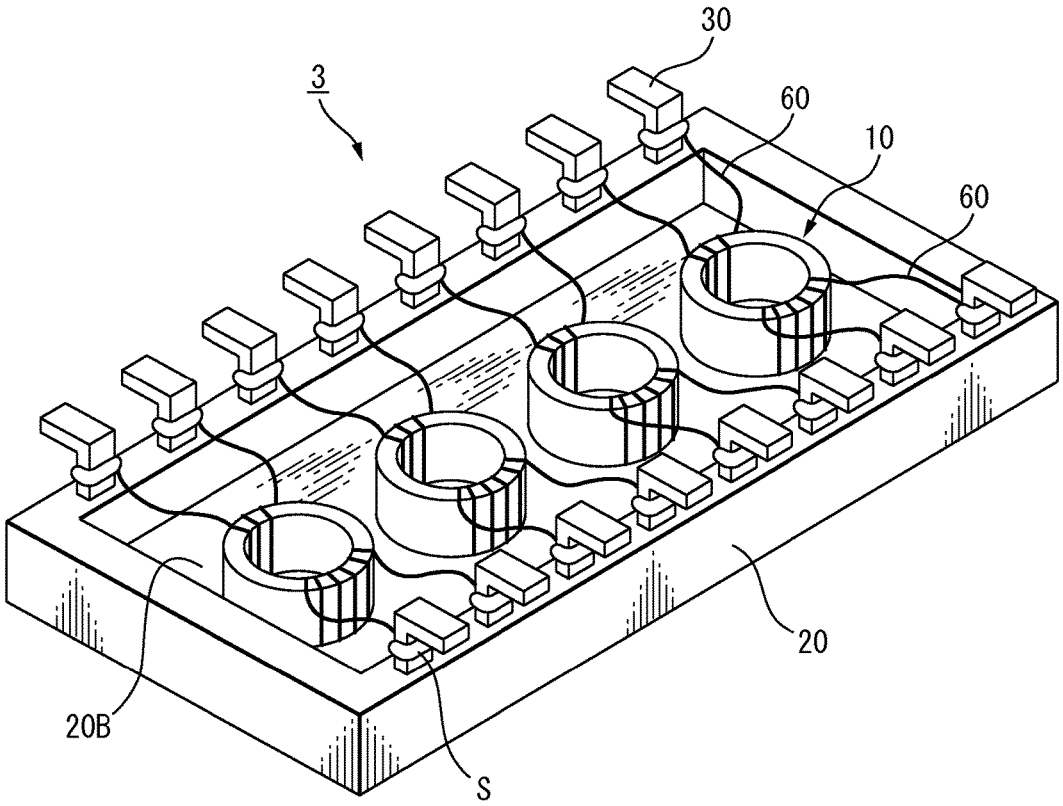
FIG. 10 is a perspective view of a transformer module which is produced by the method of production of a transformer module of the present application as seen from the back surface side.

When mounting four transformers 10 in a case 20, if performing the above steps for the four transformers 10, a transformer module 3 such as illustrated in FIG. 10 is produced. In this transformer module 3, all of the leads 60 between the cores 12 and the external terminals 30 are provided with excess lengths, so after mounting the transformer module 3 on a circuit board, even if a temperature drop causes the leads 60 to contract, the leads 60 are not liable to break.

Note that, for the first support columns 41 and the second support columns 42, the same shapes of support columns can be used. Further, the ring-shaped ridges 23 may be projections which can engage with the end parts of the cores 12. Furthermore, if making the first and second support columns 41 and 42 sublimating members, after the cores 12 are inclined and the leads 60 are electrically joined to the external terminals 30, along with the elapse of time, the first and second support columns 41 and 42 disappear, so the task of removing the first and second support columns 41 and 42 is eliminated. As the materials of the sublimating members, for example, benzene-based or pyrethroid-based materials can be used. Note that, para-dichlorobenzene leaves behind a residue after sublimation, so it is possible to confirm the use of sublimating members from the trace of that.

Figure 4A:
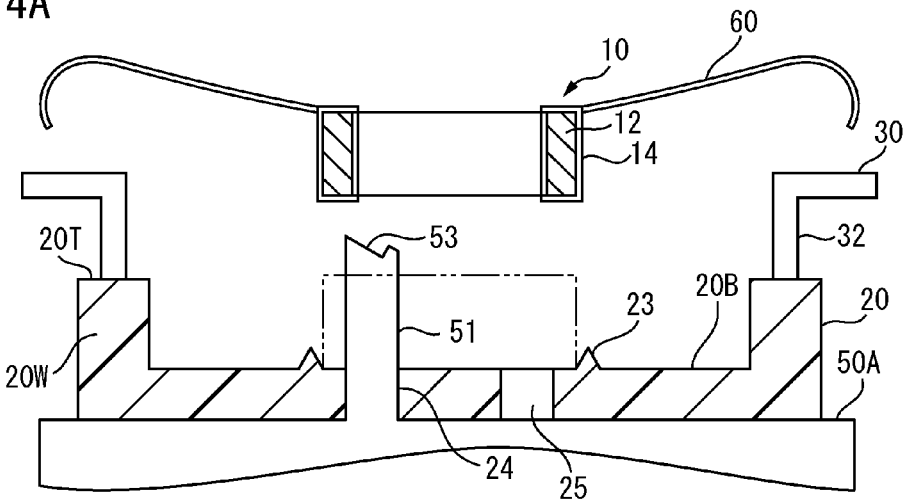
FIG. 4A to FIG. 4C are process diagrams which illustrate steps of a second embodiment of a method of production of a transformer module of the present application.
Figure 4B:
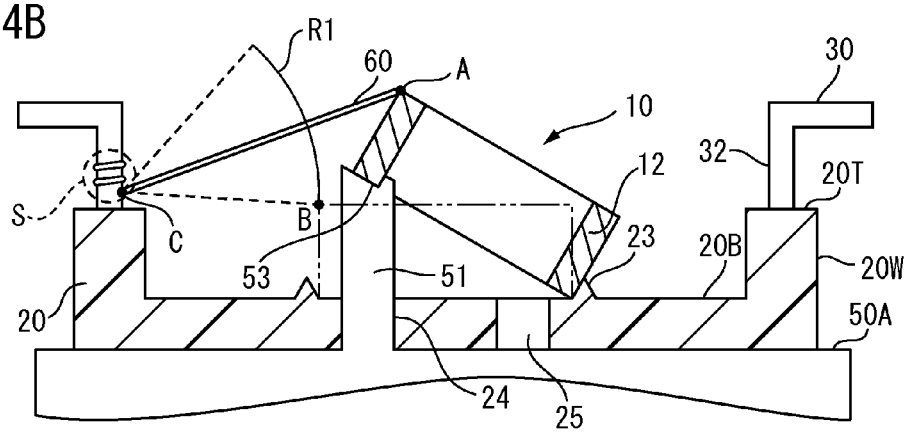
Figure 4C:
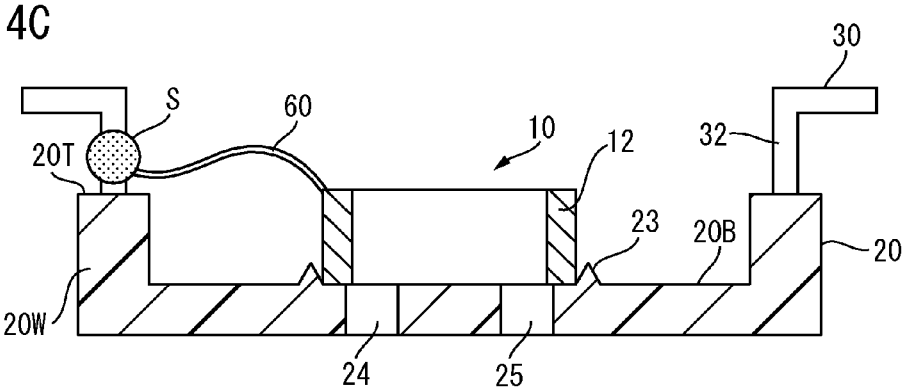

FIG. 4A to FIG. 4C are part of the process diagrams which illustrate a second embodiment of the method of production of a transformer module of the present application. In the method of production of the second embodiment, first, as illustrated in FIG. 4A, a case 20 for producing the transformer module 3 is prepared. This is placed on a first type of pedestal 50A. The case 20 is provided with the same shape and the same material as the case 20 which was used in the method of production of the first embodiment, but differs in the point that the part placement surface 20B is provided with two holes (first hole 24 and second hole 25) for each core 12. The first holes 24 and the second holes 25 are provided at the insides of the ring-shaped ridges 23. Further, the first type of pedestal 50A is provided with first mounting shafts 51 which are passed through the first holes 24. The case 20 is placed on the first type of pedestal 50A in the state with the first mounting shafts 51 inserted into the first holes 24.

The transformers 10 which are attached to the bottom surface 20B of the case 20 are also the same as the ones which are used in the method of production of the first embodiment, are provided with ring-shaped cores 12, and have windings 14 which are wound around the cores. The point that the windings 14 of the transformers 10 include primary side windings and secondary side windings and the point that leads 60 are led out from the start parts and end parts of the windings 14 of the cores 12 for connection with the terminals are also the same.

The transformers 10 are mounted at positions which are illustrated by the two-dot chain lines at the bottom surface 20B of the case 20, but in the method of production of the second embodiment, as illustrated in FIG. 4B, the outsides of the bottom surfaces of the cores 12 of the transformers 10 are engaged with the ridges 23 and, in that state, the insides of the bottom surfaces of the cores 12 at the opposite sides are supported by the support parts 53 of the first mounting shafts 51 to make the transformers 10 be inclined on the bottom surface 20B. If making the heights of the first mounting shafts 51 which stick out from the bottom surface 20B of the case 20 ones by which the cores 12 incline from the bottom surface 20B by an angle 30°, the inclination angles of the outer circumferential surfaces of the cores 12 which are engaged with the ridges 23 become 60° with respect to the bottom surface 20B. These inclination angles are the same as the inclination angles of the side surfaces of the ridges 23 with respect to the bottom surface 20B. In this state, the leads 60 which are led out from the cores 12 at the sides far from the bottom surface 20B are wound around the winding parts 32 of the external terminals 30 in the tensed state and are electrically joined by solder S. Instead of solder, a conductive binder may also be used. FIG. 4B omits illustration of the leads 60 at the sides not wound around the external terminals 30.

After this, the case 20 is pulled off from the first type of pedestal 51 to thereby place the bottom surfaces of the cores 12 on the bottom surface 20B at the insides of the ridges 23. In the method of production of the second embodiment as well, a lead-out point of a lead 60 of a core 12 when the core 12 is raised is designated as "A", a lead-out point of the lead 60 of the core 12 when the core 12 is placed on the bottom surface 20B of the case 20 is designated as "B", and a start point of the lead of the winding part 32 of the external terminal 30 is designated as "C". In this case, to give excess length to the lead 60 between the lead-out point A of the lead 60 of the core 12 when the core 12 is placed on the bottom surface 20B of the case 20 and the start point C of the lead of the winding point 32 of the external terminal 30, the distance between A-C is made larger than the distance between B-C by the amount of the excess length. That is, when drawing the arc R1 which is centered about the point C and passes through the point B, the lead-out point A which is raised up by the first mounting shaft 51 is separated from this arc R1 by the amount of the excess length by setting the height of the first mounting shaft 51 from the bottom surface 20B. The height of the first mounting shaft 51 when making the inclination angle with respect to the bottom surface 20B of the core 12 an angle of 30° satisfies this set condition.

FIG. 4C illustrates the state when pulling off the case 20 from the first type of pedestal 51 from the state which is illustrated in FIG. 4B and placing the raised bottom surfaces of the cores 12 on the bottom surface 20B in the ridges 23. FIG. 4C omits the illustration of the leads 60 at the sides not wound around the external terminals 30. As explained above, the distance between A-C is larger than the distance between B-C, so if placing the raised bottom surfaces of the cores 12 on the bottom surface 20B inside the ridges 23, the leads 60 are given excess length and flex.

Next, the cores 12 in the state which is illustrated in FIG. 4C are placed on the second type of pedestal 50B. The second type of pedestal 50B is provided with second mounting shafts 52 which can be inserted into second holes 25 of the case 20, so the second mounting shafts 52 are inserted into the second holes 25 to place the case 20 on the second type of pedestal 50B. This being so, due to the second mounting shafts 52 being inserted, at the front end parts 54 of the second mounting shafts 52, the insides of the bottom surfaces of the cores 12 at the opposite sides to the sides where the leads 60 are connected to the external terminals 30 are supported by the support parts 54 of the second mounting shafts 52, so the cores 12 become inclined on the bottom surface 20B.

At this time, a lead-out point of a lead 60 of a core 12 when the core 12 is raised is designated as "D", a lead-out point of the lead 60 of the core 12 when the core 12 is placed on the bottom surface 20B of the case 20 is designated as "E", and a start point of the lead of the winding part 32 of the external terminal 30 is designated as "F". In this case, to give excess length to the lead 60 between the lead-out point D of the lead 60 of the core 12 when the core 12 is placed on the bottom surface 20B of the case 20 and the start point F of the lead of the winding point 32 of the external terminal 30, the distance between D-F is made larger than the distance between E-F by the amount of the excess length. That is, when drawing the arc R2 which is centered about the point F and passes through the point E, the lead-out point D which is raised up by the second mounting shaft 52 is separated from this arc R2 by the amount of the excess length by setting the height of the second mounting shaft 52 from the bottom surface 20B. The height of the second mounting shaft 52 when making the inclination angle with respect to the bottom surface 20B of the core 12 an angle of 30° satisfies this set condition.

Figure 5A:
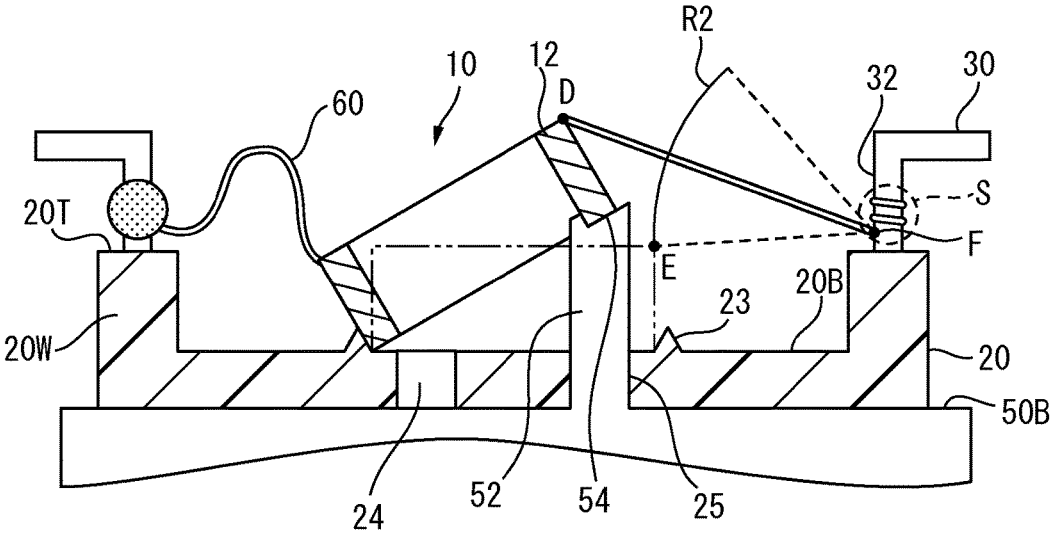
FIG. 5A and FIG. 5B are process diagrams which illustrate steps of a second embodiment of a method of production of a transformer module of the present application.
Figure 5B:
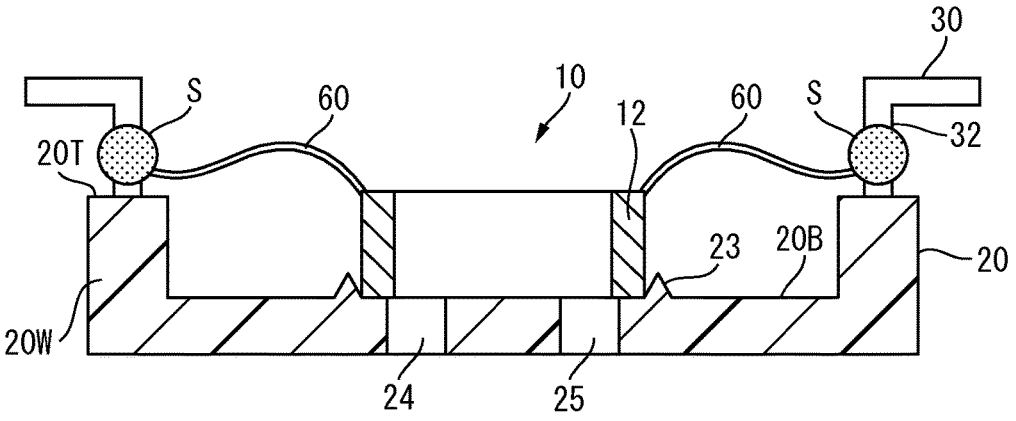

Further, if making the cores 12 incline with respect to the bottom surface 20B by 30° by adjusting the heights of the second mounting shafts 52 which stick up from the bottom surface 20B, the inclination angles of the outer circumferential surfaces of the cores 12 which are engaged with the ridges 23 with respect to the bottom surface 20B become 60°. The inclination angles are the same as the inclination angles of the side surfaces of the ridges 23 with respect to the bottom surface 20B. In this state, the leads 60 which are led out from the cores 12 at the sides far from the bottom surface 20B are wound around the winding parts 32 of the external terminals 30 in the tensed state and are electrically joined by solder S. After this, the case 20 is pulled off from the second type of pedestal 52, whereupon the raised bottom surfaces of the cores 12 are placed on the bottom surface 20B inside the ridges 23. This state is illustrated in FIG. 5B. As explained above, the distance between D-F is larger than the distance between E-F by the amount of excess length, so if placing the raised bottom surfaces of the cores 12 on the bottom surface 20B inside the ridges 23, the leads 60 are given excess length and flex. The first and second holes 24 and 25 which are provided at the case 20 can also be plugged by a resin etc.

When mounting four transformers 10 in a case 20, if performing the above steps for the four transformers 10, a transformer module 3 such as illustrated in FIG. 10 is produced. In this transformer module 3, all of the leads 60 between the cores 12 and the external terminals 30 are provided with excess lengths, so after mounting the transformer module 3 on a circuit board, even if a temperature drop causes the leads 60 to contract, the leads 60 are not liable to break. Note that, if placing the case 20 on the first type of pedestal 50A, connecting the leads 60 to the external terminals 30, pulling off the case 20 from the first type of pedestal 50A, then reversing the case 20 left to right and placing it on the first type of pedestal 50A, the second type of pedestal 60B is unnecessary.

Figure 6A:
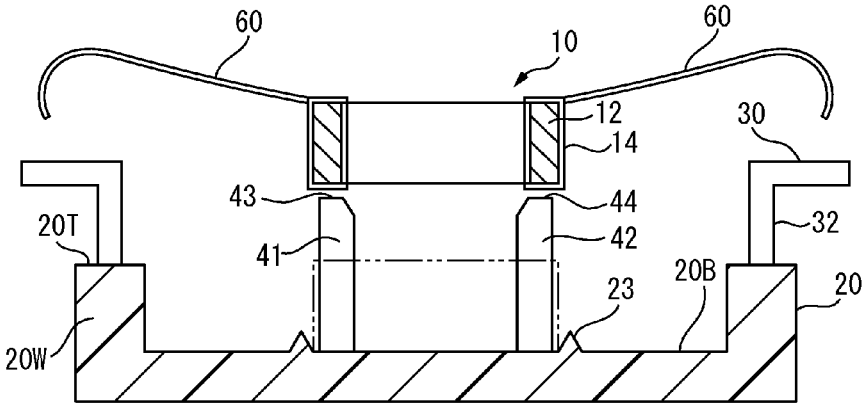
FIG. 6A to FIG. 6C are process diagrams which illustrate steps of a third embodiment of a method of production of a transformer module of the present application.
Figure 6B:
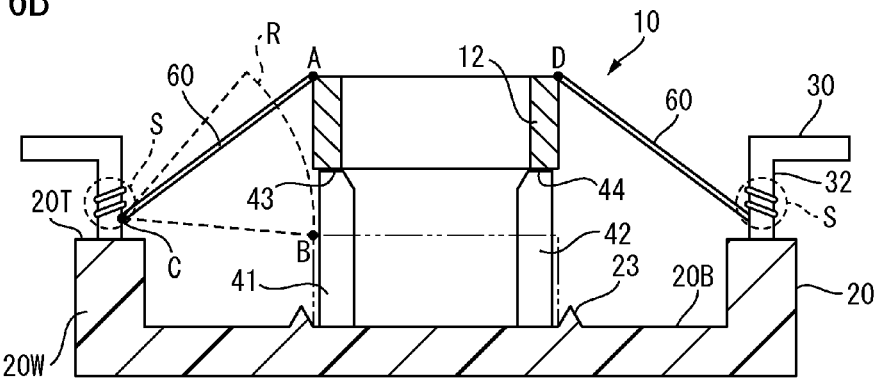
Figure 6C:
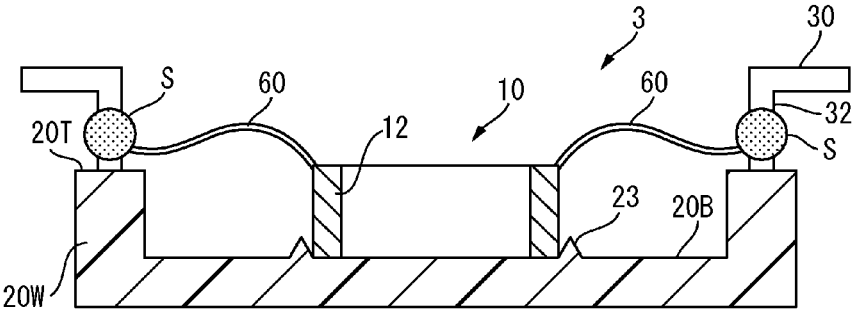

FIG. 6A to FIG. 6C are process diagrams which illustrate a third embodiment of the method of production of a transformer module of the present application. In the method of production of the third embodiment, first, as illustrated in FIG. 6A, a case 20 for producing the transformer module 3 is prepared. The case 20 is provided with the same shape and the same material as the case 20 which was used in the method of production of the first embodiment and is provided with a bottom surface 20B, wall parts 20W, positioning ridges 23, and external terminals 30. The wall parts 20W are provided adjacent to the bottom surface 20B. The top surfaces 20T of the wall parts 20W are provided with a plurality of external terminals 30.

The transformers 10 which are attached to the bottom surface 20B of the case 20 are also the same as those which are used in the method of production of the first embodiment. They are provided with ring-shaped cores 12, while the cores have windings 14 wound around them. The point that the windings 14 of the transformers 10 include primary side windings and secondary side windings and the point that leads 60 for connecting to the terminals are led out from the start parts and end parts of the windings 14 of the cores 12 are also the same.

In the method of production of the third embodiment, first, at least two support columns of the same lengths (here, made the first support columns 41 and the second support columns 42) are set at the insides of the ring-shaped ridges 23. Next, the cores 12 of the transformers 10 which are provided with the above-mentioned structures are placed on the support parts 43 and 44 at the end parts of the first and second support columns 41 and 42. The cores 12 are placed on the support parts 43 and 44 of the first and second support columns 41 and 42 so that the outer circumferential parts of the cores 12 are inside of the ring-shaped ridges 23.

FIG. 6B illustrates the state where cores 12 are placed on the support parts 43 and 44 of the first and second support columns 41 and 42 from the state which is illustrated in FIG. 6A and the leads 60 which are led out from the cores 12 are wound around the winding parts 32 of the external terminals 30 to lay them there. The leads 60 which are wound around the winding parts 32 of the external terminals 30 are electrically joined to the external terminals 30 by solder S or a conductive binder.

Here, a lead-out point of a lead 60 of a core 12 which is placed on the support parts 43 and 44 of the first and second support columns 41 and 42 is designated as "A", a lead-out point of the lead 60 of the core 12 when the transformer 10 is placed on the bottom surface 20B is designated as "B", and a start point of the lead of the winding part 32 of the external terminal 30 is designated as "C". To give excess length to the lead 60 between the point B and the point C when removing the first and second support columns 41 and 42 and lowering the core 12 which is placed on the support parts 43 and 44 to the bottom surface 20B, the distance between the point A and the point C has to be made larger than the distance between the point A and the point C by exactly the amount of the excess length. That is, when drawing the arc R which is centered about the point C and passes through the point B, the lead-out point A of the lead 60 of the core 12 which is raised up by the first and second support columns 41 and 42 is separated from this arc R by the amount of the excess length by setting the heights of the first and second support columns 41 and 42.

If detaching the first and second support columns 41 and 42 from the bottom surface 20B from the state which is illustrated in FIG. 6B, the cores 12 which are placed on the first and second support columns 41 and 42 move up to the bottom surface 20B of the case 20. In the state where the cores 12 are placed on the bottom surface 20B of the case 20, the distance between the point B and the point C is shorter than the distance between the point A and the point C, so the leads 60 between the point B and the point C are provided with excess length and the leads 60 flex.

When mounting four transformers 10 in a case 20, if performing the above steps for the four transformers 10, a transformer module 3 such as illustrated in FIG. 10 is produced. In this transformer module 3, all of the leads 60 between the cores 12 and the external terminals 30 are provided with excess lengths, so after mounting the transformer module 3 on a circuit board, even if a temperature drop causes the leads 60 to contract, the leads 60 are not liable to break.

Further, as the first and second support columns 41 and 42, sublimating members can be used. In this case, after the cores 12 are placed on the first and second support columns 41 and 42 and the leads 60 are electrically joined to the external terminals 30, along with the elapse of time, the first and second support columns 41 and 42 disappear, so the task of removing the first and second support columns 41 and 42 is eliminated. As the materials of the sublimating members, for example, benzene-based or pyrethroid-based materials can be used. Note that, para-dichlorobenzene leaves behind a residue after sublimation, so it is possible to confirm the use of sublimating members from the trace of that.

Figure 7A:
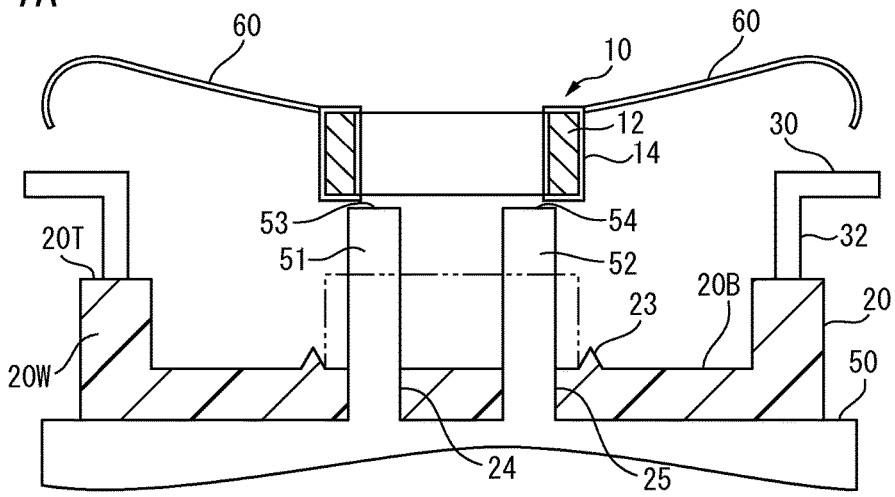
FIG. 7A to FIG. 7C are process diagrams which illustrate steps of a fourth embodiment of a method of production of a transformer module of the present application.
Figure 7B:
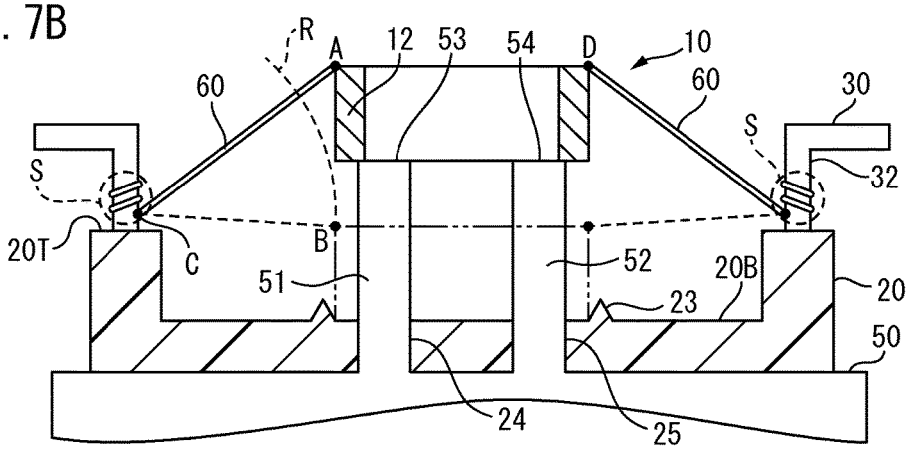
Figure 7C:
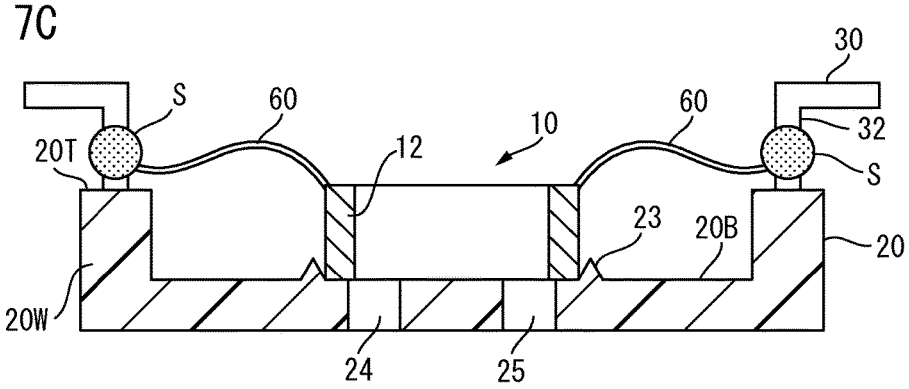

FIG. 7A to FIG. 7C are process diagrams which illustrate a fourth embodiment of the method of production of a transformer module of the present application. First, as illustrated in FIG. 7A, a case 20 for producing the transformer module 3 is prepared. This is placed on a third type of pedestal 50. The case 20 is provided with the same shape and the same material as the case 20 which was used in the method of production of the second embodiment and is provided with a part placement surface 20B in which two holes (first hole 24 and second hole 25) are formed for each core 12. The first holes 24 and the second holes 25 are provided at the insides of the ring-shaped ridges 23. Further, the third type of pedestal 50 is provided with first mounting shafts 51 which are passed through the first holes 24 and second mounting shafts 52 which are passed through the second holes 25. The case 20 is placed on the third type of pedestal 50 in the state with the first mounting shafts 51 inserted into the first holes 24 and the second mounting shafts 52 inserted into the second holes 25.

The transformers 10 which are attached to the bottom surface 20B of the case 20 are also the same as those which are used in the method of production of the first to third embodiments. They are provided with ring-shaped cores 12, while the cores have windings 14 wound around them. The point that the windings 14 of the transformers 10 include primary side windings and secondary side windings and the point that leads 60 for connecting to the terminals are led out from the start parts and end parts of the windings 14 of the cores 12 are also the same. Transformers 10 which are provided with such a structure are placed at their cores 12 on support parts 53 and 54 which are positioned at end parts of the first and second mounting shafts 51 and 52. The cores 12 are placed on the support parts 53 and 54 of the first and second mounting shafts 51 and 52 so that their outer circumferential parts are inside the ring-shaped ridges 23.

FIG. 7B illustrates the state where cores 12 are placed on the support parts 53 and 54 of the first and second mounting shafts 51 and 52 from the state which is illustrated in FIG. 7A and the leads 60 which are led out from the cores 12 are wound around the winding parts 32 of the external terminals 30 and tensed. The leads 60 which are wound around the winding parts 32 of the external terminals 30 are electrically joined to the external terminals 30 by solder S or a conductive binder.

Here, a lead-out point of a lead 60 of a core 12 which is placed on the support parts 53 and 54 of the first and second mounting shafts 51 and 52 is designated as "A", a lead-out point of the lead 60 from the core 12 when the transformer 10 is placed on the bottom surface 20B is designated as "B", and a start point of the lead of the winding part 32 of the external terminal 30 is designated as "C". To give excess length to the lead 60 between the point B and the point C when the core 12 which is placed on the support parts 53 and 54 of the first and second mounting shafts 51 and 52 is lowered to the bottom surface 20B, the distance between the point A and the point C has to be made larger than the distance between the point B and the point C by the amount of the excess length. That is, for the arc R which is centered about the point C and passes through the point B, the lead-out point A of the lead 60 of a core 12 which is supported by the first and second mounting shafts 51 and 52 should be made to be separated from this arc R by the amount of the excess length by setting the heights of parts of the first and second mounting shafts 51 and 52 from the bottom surface 20B.

If pulling off the case 20 from the pedestal 50 from the state which is illustrated in FIG. 7B, the cores 12 which are placed on the first and second mounting shafts 51 and 52 move up to the bottom surface 20B of the case 20. In the state where the cores 12 are placed on the bottom surface 20B of the case 20, the distance between the point B and the point C is shorter than the distance between the point A and the point C, so the leads 60 between the point B and the point C are provided with excess length and the leads 60 flex.

When mounting four transformers 10 in a case 20, if performing the above steps for the four transformers 10, a transformer module 3 such as illustrated in FIG. 10 is produced. In this transformer module 3, all of the leads 60 between the cores 12 and the external terminals 30 are provided with excess lengths, so after mounting the transformer module 3 on a circuit board, even if a temperature drop causes the leads 60 to contract, the leads 60 are not liable to break.

Figure 8A:
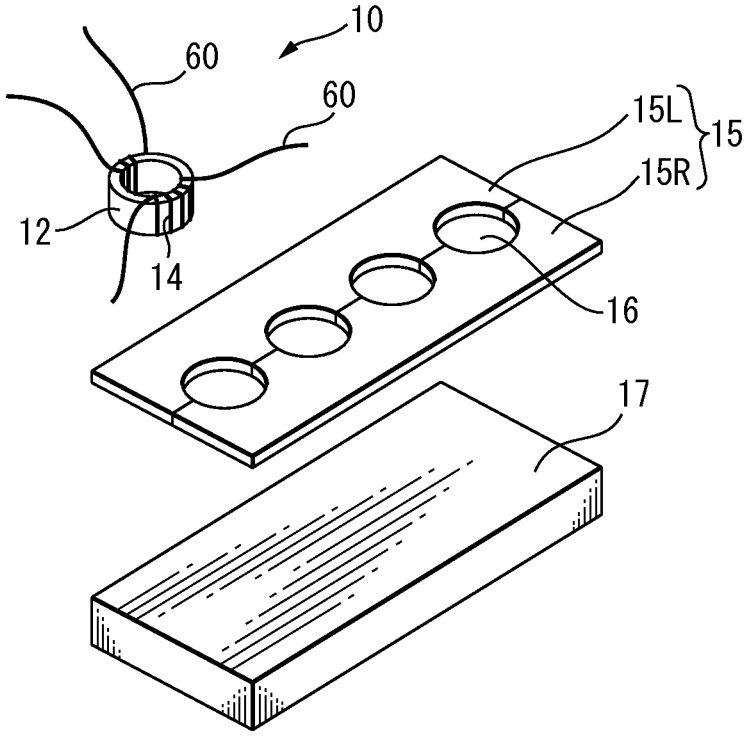
FIG. 8A and FIG. 8B are process diagrams which illustrate steps of a fifth embodiment of a method of production of a transformer module of the present application.

FIGS. 8A and 8B and FIGS. 9A and 9B are process diagrams which illustrate a fifth embodiment of the method of production of a transformer module of the present application. As illustrated in FIG. 8A, in the method of production of the fifth embodiment, a sheet 17 which is formed by a sublimating member (hereinafter referred to as a "sheet-shaped sublimating member") is used. The thickness of the sheet-shaped sublimating member 17 may be the same as the first and second support columns 41 and 42 which are used in the third embodiment, while the outside dimensions of the sheet-shaped sublimating member 17 are made the same dimensions as the bottom surface 20B of the case 20. As the materials of the sublimating member, for example, benzene-based or pyrethroid-based materials can be used. Note that, para-dichlorobenzene leaves behind a residue after sublimation, so it is possible to confirm the use of the sublimating member from the trace of that.

Further, in the fifth embodiment, a guide plate 15 which is provided with the same area and shape as the bottom surface 20B of the case 20 is prepared. The guide plate 15 is not particularly limited in thickness, but height is not required. The guide plate 15 is provided with positioning holes 16 for setting the positions of the transformers 10 at the bottom surface 20B of the core 12 in a number corresponding to the transformers 10 which are set in the case 20. Further, the guide plate 15 is designed to be able to be split into a left guide plate 15L and a right guide plate 15R in the present embodiment. After the transformers 10 are positioned on the sheet-shaped sublimating member 17, the plate may be split and removed from the sheet-shaped sublimating member 17.

The transformers 10 which are attached to the bottom surface 20B of the case 20 are also the same as those which are used in the method of production of the first to fourth embodiments. They are provided with ring-shaped cores 12, while the cores have windings 14 wound around them. The point that the windings 14 of the transformers 10 include primary side windings and secondary side windings and the point that leads 60 for connecting to the terminals are led out from the start parts and end parts of the windings 14 of the cores 12 are also the same.

Figure 8B:
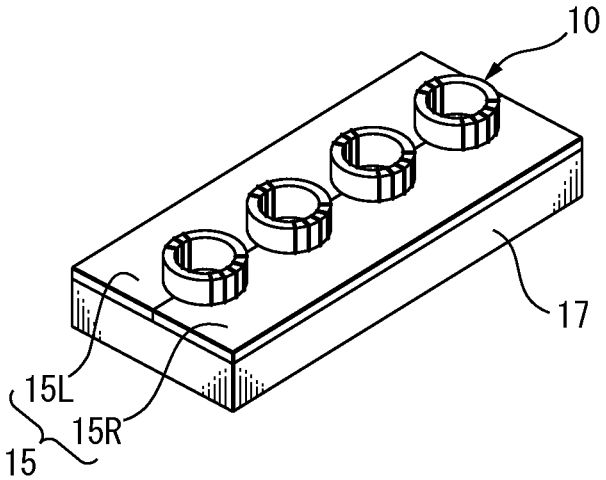

Transformers 10 which are provided with such a structure are placed, as illustrated in FIG. 8B, on the sheet-shaped sublimating member 17 on which the guide plate 15 is provided at positions of the positioning holes 16. Note that, FIG. 8B omits illustration of the leads 60 which are led out from the transformers 10. After the transformers 10 are positioned on the sheet-shaped sublimating member 17, the guide plate 15 is split into the left guide plate 15L and the right guide plate 15R and is removed from the sheet-shaped sublimating member 17. Note that, the guide plate 15 may be removed from the sheet-shaped sublimating member 17 at a later step as well.

Figure 9A:
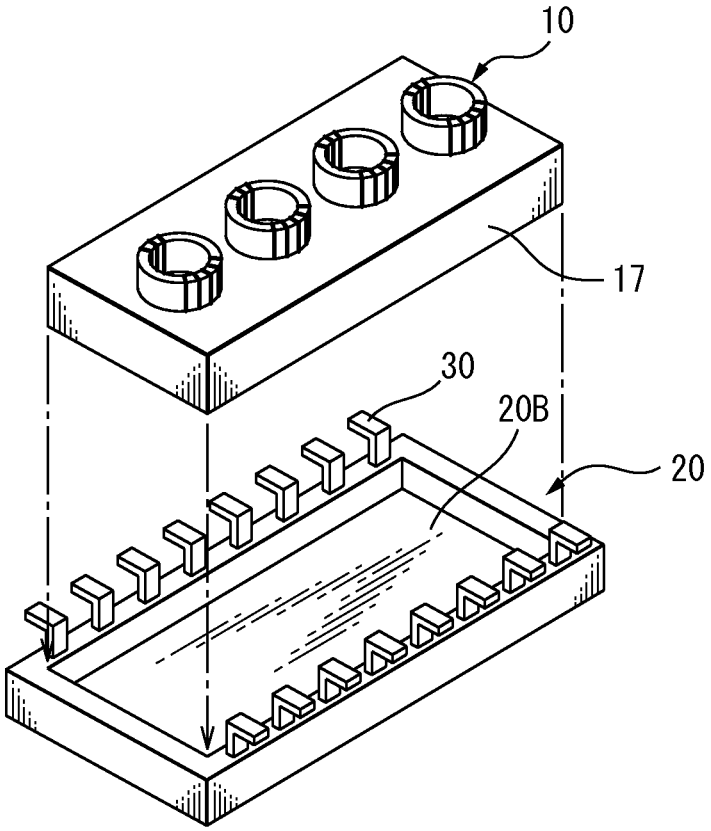
FIG. 9A and FIG. 9B are process diagrams which illustrate steps of a fifth embodiment of a method of production of a transformer module of the present application.
Figure 9B:
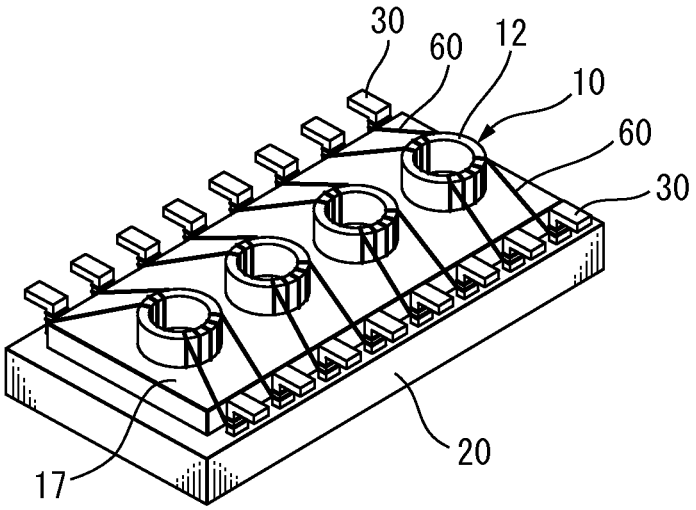

After this, as illustrated in FIG. 9A, the sheet-shaped sublimating member 17 at which the transformers 10 are arranged is placed on the bottom surface 20B of the case 20. The bottom surface 20B of the case 20 which is used in the fifth embodiment need not have positioning use ridges for the transformers 10. FIG. 9A also omits illustration of the leads 60 which are led out from the transformers 10. After the sheet-shaped sublimating member 17 on which the transformers 10 are arranged is placed on the bottom surface 20B of the case 20, as illustrated in FIG. 9B, the leads 60 which are led out from the transformers 10 are strung to the external terminals 30 and soldered to them. Instead of solder, a conductive binder may be used to electrically connect the leads 60 to the external terminals. At this time, the transformers 10 are kept from shifting in position on the sheet-shaped sublimating member 17.

In this state, along with the elapse of time, the sheet-shaped sublimating member 17 which is formed by the sublimating material disappears, whereby the cores 12 of the transformers 10 are placed on the bottom surface 20B of the case 20 and the transformer module 3 such as illustrated in FIG. 10 is produced. In this transformer module 3, all of the leads 60 between the cores 12 and the external terminals 30 are provided with excess lengths, so after mounting the transformer module 3 on a circuit board, even if a temperature drop causes the leads 60 to contract, the leads 60 are not liable to break. Accordingly, a high reliability of connection between the windings 14 of the transformers 10 and the external terminals 30 can be maintained.

Although only some exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention.

What is claimed is:

1. A method of production of a transformer module which comprises a case inside of which transformers which include cores, primary windings, and secondary windings are set at a part placement surface and where leads of the primary windings and secondary windings are connected to external terminals which are provided at the case, which method of production of a transformer module comprising inserting spacers at the bottom surfaces of the cores to separate the bottom surfaces of the cores from the part placement surface and support them, stringing the leads from the cores to the external terminals and electrically joining them, after joining them, removing the spacers to place the bottom surfaces of the cores at said part placement surface, and fastening the cores to the part placement surface.

2. The method of production of a transformer module according to claim 1 which further comprises inserting, as said spacers, support columns at said part placement surface and placing said cores on said part placement surface in a state placing the bottom surfaces of said cores near the lead-out points of the leads of said windings on said support columns, stringing said leads at the sides placed on said support columns to said external terminals and electrically joining them, and removing said support columns to place the bottom surfaces of said cores on said part placement surface.

3. The method of production of a transformer module according to claim 2 which further comprises, after the bottom surfaces of said cores are placed on said part placement surface, lifting up the bottom surfaces of said cores at the opposite sides from said part placement surface and inserting said support columns between the bottom surfaces of said cores and said part placement surface, placing the lifted up bottom surfaces of said cores near the lead-out points of the leads of said windings on the inserted support columns, stringing said leads at the sides placed on said support columns to said external terminals and electrically joining them, and, after said support columns are removed and the bottom surfaces of said cores are placed on said part placement surface, fastening said cores to said part placement surface.

4. The method of production of a transformer module according to claim 2 wherein said support columns can be reused after being taken out from said part placement surface.

5. The method of production of a transformer module according to claim 2 wherein said support columns are made by sublimating members which disappear along with the elapse of time.

6. The method of production of a transformer module according to claim 2 wherein the heights of said support columns from said part placement surface are made so that distances between lead-out points of said leads and said external terminals in the state supported by said support columns become longer than distances between lead-out points of said leads and said external terminals at the time when said cores are placed on said part placement surface.

7. The method of production of a transformer module according to claim 1 which further comprises inserting and standing up, as said spacers, a plurality of support columns at said part placement surface and placing bottom surfaces of said cores on said plurality of support columns to separate them from part placement surface and support them, in that state, stringing said leads at the two sides of the cores to said external terminals and electrically joining them, and, after joining them, removing said plurality of support columns so that the bottom surfaces of said cores are placed on said part placement surface, then fastening said cores to said part placement surface.

8. The method of production of a transformer module according to claim 1 which further comprises making said spacers mounting shafts which are provided on a pedestal, providing holes which are positioned near the lead-out points of the leads of said windings at parts of said part placement surface where said transformers are to be set, placing said case on said pedestal by inserting said mounting shafts in said holes, placing said cores on the part placement surface in the state where bottom surfaces of said cores near the lead-out points of the leads of said windings are placed on the end faces of said mounting shafts, stringing said leads at sides placed on the end faces of said mounting shafts to said external terminals and electrically joining them, and taking said case off from said pedestal and fastening the bottom surfaces of said cores to said part placement surface.

9. The method of production of a transformer module according to claim 8 wherein the heights of said mounting shafts from said part placement surface are made so that distances between lead-out points of the leads of said windings and said external terminals in the state supported by said mounting shafts become longer than distances between lead-out points of the leads of said windings and said external terminals in the state where said cores are placed on said part placement surface.

10. The method of production of a transformer module according to claim 1 which further comprises making said spacers first mounting shafts which are provided on a first pedestal and second mounting shafts which are provided on a second pedestal, providing first holes which are positioned near the lead-out points of the leads of said windings at parts of said part placement surface where said transformers are to be set and second holes which are positioned near the lead-out points of the leads of said windings at the opposite sides of the cores, placing said case on said first pedestal by inserting said first mounting shafts in said first holes, placing said cores on the part placement surface in the state where bottom surfaces of said cores near the lead-out points of the leads of said windings are placed on the end faces of said first mounting shafts, stringing said leads at sides placed on the end faces of said first mounting shafts to said external terminals and electrically joining them, taking said case off from said first pedestal and fastening the bottom surfaces of said cores to said part placement surface, placing said case on said second pedestal by inserting said second mounting shafts in said second holes, placing said cores on the part placement surface in the state where bottom surfaces of said cores near the lead-out points of the leads of said windings at the opposite sides of the cores are placed on the end faces of said second mounting shafts, stringing said leads at sides placed on the end faces of said second mounting shafts to said external terminals and electrically joining them, taking said case off from said second pedestal and, after the bottom surfaces of said cores are placed on said part placement surface, fastening said cores to said part placement surfaces.

11. The method of production of a transformer module according to claim 10 wherein the heights of the end faces of said first and second mounting shafts from said part placement surface are made so that distances between lead-out points of the leads of said windings and said external terminals in the state supported by said first and second mounting shafts become longer than distances between lead-out points of the leads of said windings and said external terminals in the state where said cores are placed on said part placement surface.

12. The method of production of a transformer module according to claim 1 which further comprises making said spacers first mounting shafts and second mounting shafts which are provided on a pedestal, providing first holes which are positioned near the lead-out points of the leads of said windings from said cores at parts of said part placement surface where said transformers are to be set and second holes which are positioned near the lead-out points of the leads of said windings at the opposite sides of the cores, placing said case on said pedestal by inserting said first mounting shafts in said first holes and said second mounting shafts in said second holes, placing the bottom surfaces of said cores near the lead-out points of the leads of said windings at the two sides of the transformers on the end faces of said first and second mounting shafts which stick out from said part placement surface, in this state, stringing said leads at the two sides of said cores to said external terminals and electrically joining them, and taking said case off from said pedestal and, after the bottom surfaces of said cores are placed on said part placement surface, fastening said cores to said part placement surfaces.

13. The method of production of a transformer module according to claim 1 which further comprises making said spacers a sheet-shaped sublimating member which is laid over the entire extent of said part placement surface, arranging cores of said transformers on the top surface of said sheet-shaped sublimating member parallel to said part placement surface in the same way as arranging them on said part placement surface, in that state, stringing said leads at the two sides of the cores to said external terminals and electrically joining them, and, after joining them, fastening said cores to said part placement surface after said sheet-shaped sublimating member disappears due to sublimation and the cores of said transformers are placed on said part placement surface.

14. The method of production of a transformer module according to claim 13 wherein the height of the top surface of said sheet-shaped sublimating member from said part placement surface is made so that distances between lead-out points of the leads of said windings and said external terminals in the state supported by said sublimating member become longer than distances between lead-out points of the leads of said windings and said external terminals in the state where said cores are placed on said part placement surface.

15. The method of production of a transformer module according to claim 1 wherein said leads are wound around said external terminals, then are electrically joined with said external terminals by said conductive members.

16. The method of production of a transformer module according to claim 15 wherein said conductive members are either of a conductive binder and solder.

17. The method of production of a transformer module according to claim 1 wherein said external terminals are provided at facing wall parts of said part placement surface of said case.

18. The method of production of a transformer module according to claim 1 wherein said part placement surface is provided with projections for positioning use which determine the positions of placement of the cores of said transformers.

19. The method of production of a transformer module according to claim 18 wherein said projections are ring-shaped ridges which define the positions of the outer circumferential parts of said cores.

* * * * *